US006913189B2

(12) United States Patent
Oliff et al.

(10) Patent No.: US 6,913,189 B2
(45) Date of Patent: Jul. 5, 2005

(54) SEPARABLE DUAL CARTON

(75) Inventors: Jimmy Oliff, Douglasville, GA (US); Aaron L. Bates, Marietta, GA (US); Ronald A. Baxter, Douglasville, GA (US)

(73) Assignee: MeadWestvaco Packaging Systems, LLC, Stamford, CT (US)

( * ) Notice: Subject to any disclaimer, the term of this patent is extended or adjusted under 35 U.S.C. 154(b) by 230 days.

(21) Appl. No.: 10/456,233

(22) Filed: Jun. 6, 2003

(65) Prior Publication Data

US 2004/0245327 A1 Dec. 9, 2004

(51) Int. Cl.[7] ..... B65D 5/54
(52) U.S. Cl. ..... 229/120.011; 229/240
(58) Field of Search ..... 229/120.011, 120.11, 229/240

(56) References Cited

U.S. PATENT DOCUMENTS 2,973,130 A 2/1961 Cottrill
3,677,458 A 7/1972 Gosling
3,758,021 A * 9/1973 Gordon-Ross ..... 229/120.011
4,487,319 A * 12/1984 Barrash ..... 229/120.011
4,533,052 A 8/1985 Fruchey et al.
4,913,291 A * 4/1990 Schuster ..... 229/120.011
4,919,269 A 4/1990 Wright et al.
5,012,929 A * 5/1991 Roosa ..... 229/120.011
5,857,570 A * 1/1999 Brown ..... 229/120.11
6,371,365 B1 * 4/2002 Doucette et al. ..... 229/120.011

* cited by examiner

*Primary Examiner*—Gary E. Elkins
(74) *Attorney, Agent, or Firm*—Tsugihiko Suzuki

(57) ABSTRACT

A separable dual carton for accommodating separate quantities of articles. The dual carton includes a plurality of panels hingedly connected to one another. A center top panel includes a tear strip which overlies at least one starter orifice. The starter orifice is formed from apertures in opposing panels which are sized and positioned to register with one another when the dual carton is erected. By removing at least a portion of the tear strip, the starter orifice becomes accessible to facilitate the separation of the dual carton into separate individual cartons.

22 Claims, 6 Drawing Sheets

SEPARABLE DUAL CARTON

TECHNICAL FIELD

The present invention relates generally to paperboard cartons for use in packaging articles and, more particularly, relates to the manner in which a dual carton may be divided into separate individual cartons for accommodating separate quantities of articles.

BACKGROUND OF THE INVENTION

Dual cartons are useful for allowing consumers to purchase and transport a single carton of the desired quantity of articles such as soft drinks. After the dual carton has reached its final destination, the consumer may divide the dual carton into separate individual cartons leaving both cartons intact. One individual carton may then be separately used while the other is stored.

The individual cartons of the dual carton may be detachably retained together with the use of the combination of adhesive and tear strips. The tear strips and the adhesive are utilized between the individual cartons. Once it becomes desirable to separate the dual carton into the individual cartons, the consumer removes the tear strip to permit the individual cartons to be separated from one another. Examples of dual cartons utilizing tear strips are taught in U.S. Pat. Nos. 2,973,130; 3,677,458; and 4,533,052.

Finger tabs or push tabs may also be used to facilitate the separation of the dual carton into the individual cartons as taught in U.S. Pat. No. 3,677,458. The finger tabs may be positioned on the exterior of the dual carton between the individual cartons. However, accidental contact with the finger tabs may sometimes break the tabs which results in undesired exposure of starter orifices that are created in the carton wall by the breakage or displacement of the finger tabs. This would detract from the appearance of the dual carton because the starter orifices are designed to be used only when the separation of the carton is intended.

Also, it is often desirable to have large graphic areas on the exterior of a carton for printing and/or labeling. Utilizing the finger tabs as taught in U.S. Pat. No. 3,677,458 may not considerably interrupt the available graphic area. However, the small finger tabs could be camouflaged by graphics and thus not visible enough for consumers to fully utilize the finger tabs.

Therefore, there is a need for an improved dual carton adapted to be divided into two individual cartons for separate use. The starter orifices for facilitating the separation of the dual carton should be well hidden from view till the time for separation of the carton and they should become clearly visible once the separation of the carton is intended.

SUMMARY OF THE INVENTION

The present invention provides a dual carton for accommodating separate quantities of articles which may be divided into separate individual cartons by removal of a tear strip to provide access to an underlying starter orifice for spreading apart the individual cartons.

Generally described, the separable dual carton of the present invention includes a plurality of panels hingedly connected to one another. A center top panel includes a tear strip which overlies at least one starter orifice for receiving user's finger(s). When forming the dual carton, the starter orifice is formed from a combination of apertures in adjoining panels. The apertures are sized and positioned to register with one another when the hinged panels are folded to erect the dual carton. By removing at least a potion of the tear strip from the center top panel of the dual carton, the starter orifice is exposed and becomes accessible to facilitate the separation of the dual carton into individual cartons.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
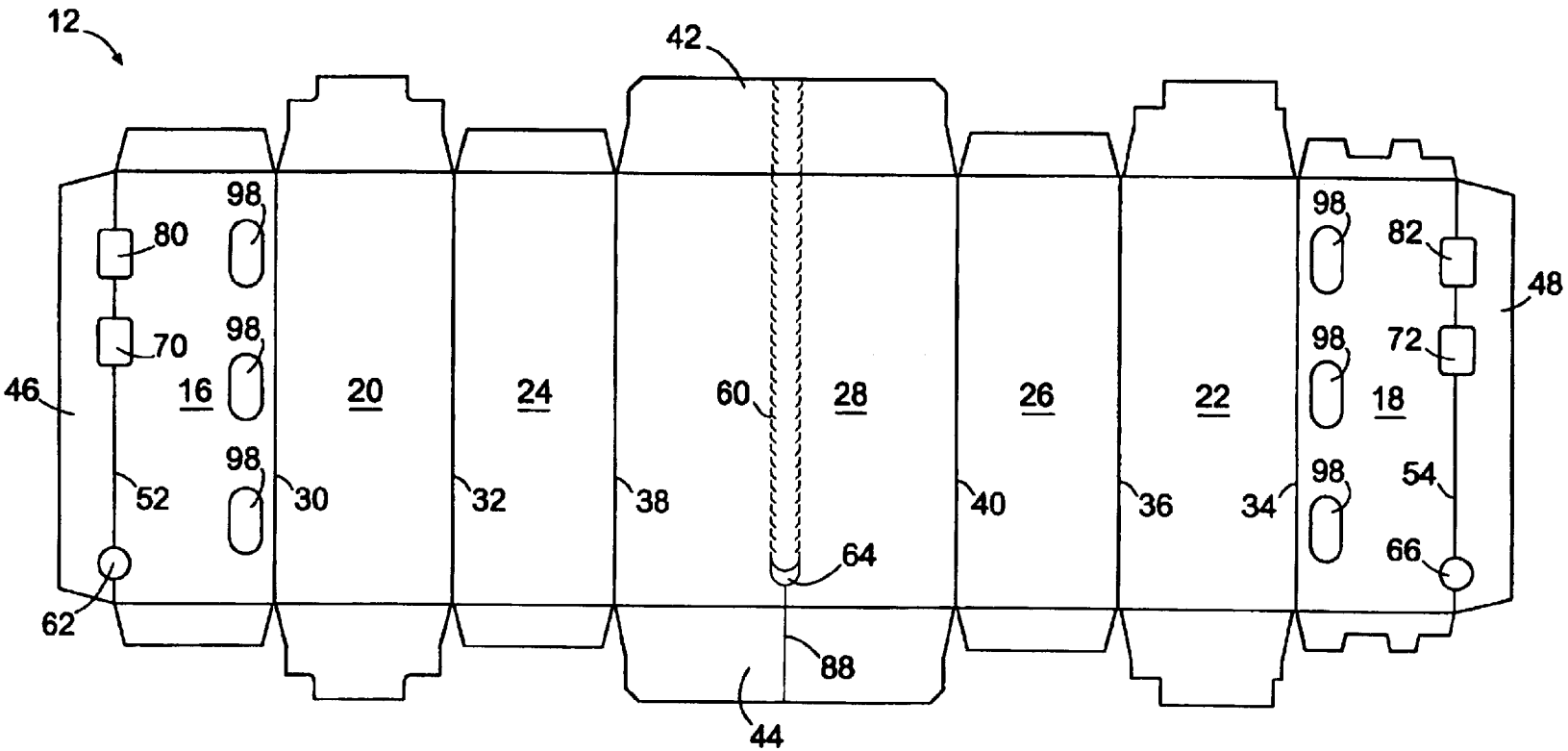
FIG. 1 illustrates a plan view of one embodiment of a blank for forming the separable dual carton of the present invention having a starter orifice underling a tear strip.

Referring now to the drawings in which like numerals indicate like elements throughout the several views, the drawings illustrate an exemplary embodiment of a separable dual carton 10 of the present invention. In one embodiment, the dual carton 10 is separable into a pair of individual cartons with dispensers for dispensing articles such as cans of soft drink.

Generally described, the dual carton 10 is formed from a blank 12 of a foldable sheet material such as paperboard as shown in FIG. 1. The blank 12 includes seven primary panels for forming the dual carton 10. The panels of the blank 12 are a first intermediate panel 16, a second intermediate panel 18, a first bottom panel 20, a second bottom panel 22, a first side panel 24, a second side panel 26, and a center top panel 28.

As shown in FIG. 1, the panels of the blank 12 are hingedly connected in series to one another. The first intermediate panel 16 is hingedly connected to an edge of the first bottom panel 20 by fold line 30. The first bottom panel 20 is then hingedly connected to an edge of the first side panel 24 by fold line 32. The second intermediate panel 18 is hingedly connected to an edge of the second bottom panel 22 by fold line 34. The second bottom panel 22 is then hingedly connected to an edge of the second side panel 26 by fold line 36. The center top panel 28 is then connected at its opposing side edges to the first and second side panels 24 and 26 by fold lines 38 and 40, respectively.

Each of the panels 16, 18, 20, 22, 24 and 26 include opposing end flaps defined by additional transverse fold lines. In particular, the center top panel 28 includes opposing end flaps 42 and 44. Also, flap panels 46 and 48 extend along the longitudinal lengths of intermediate panels 16 and 18, respectively. The flap panels 46 and 48 are defined along their edges by fold lines 52 and 54, respectively. The fold lines 52 and 54 are the outermost fold lines of the blank 12 relative the center top panel 28. The flap panels 46 and 48 have free edges opposite the fold lines 52 and 54.

As best shown in FIG. 1, the center top panel 28 includes a tear strip 60 which is disposed along the length of the center top panel 28 and extends onto the end flap 42. The tear strip 60 may be a two-line tear strip, tear string, tear tape, or the equivalent. Preferably, the tear strip 60 is a two-line tear strip that is defined between a pair of parallel frangible/severance lines and does not extend the full length of the center top panel 28.

Figure 2:
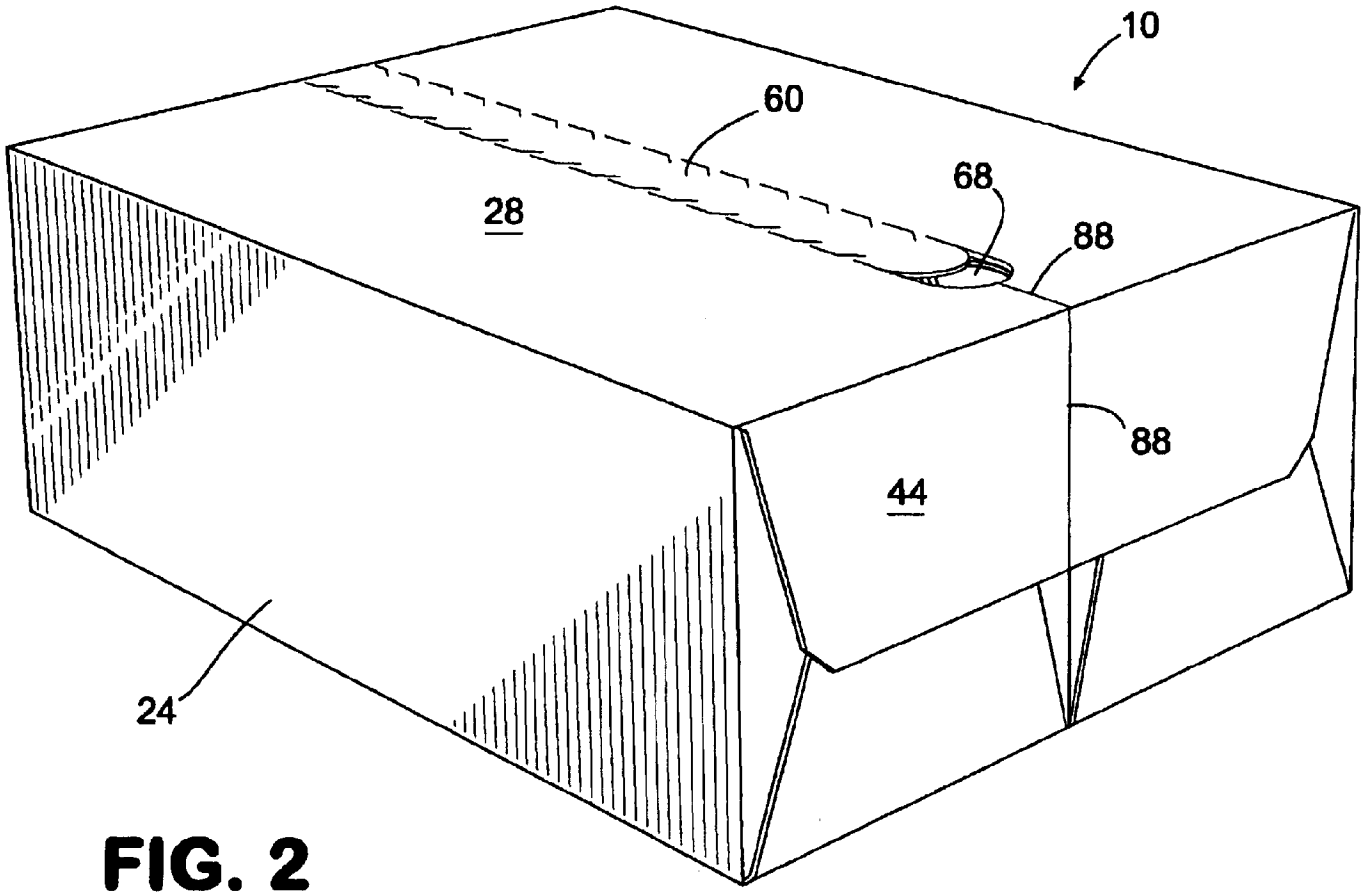
FIG. 2 is a perspective view of the dual carton of the present invention formed from the blank of FIG. 1.
Figure 3:
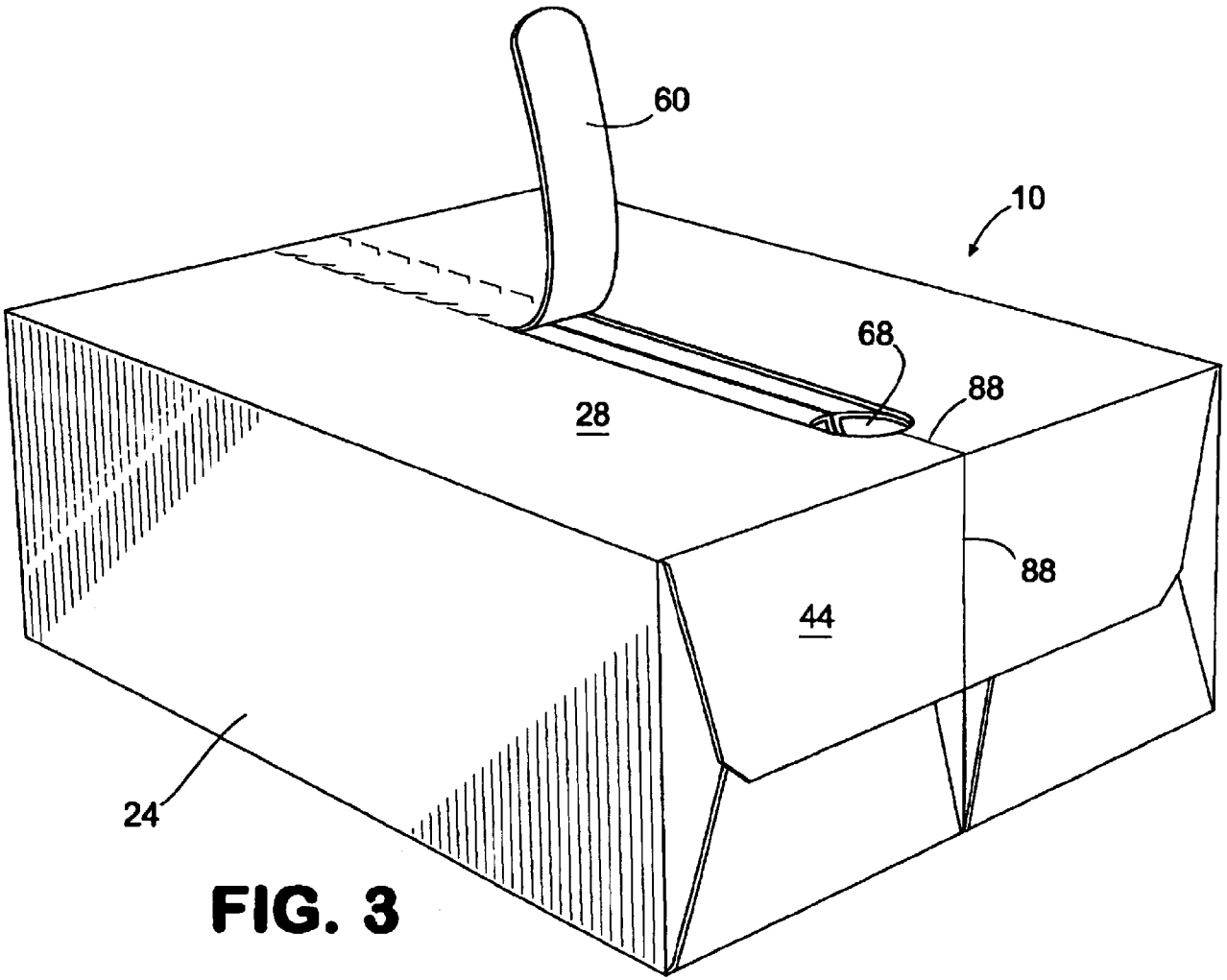
FIG. 3 is a perspective view of the dual carton illustrating the removal of the tear strip for separating the dual carton into individual cartons.
Figure 4:
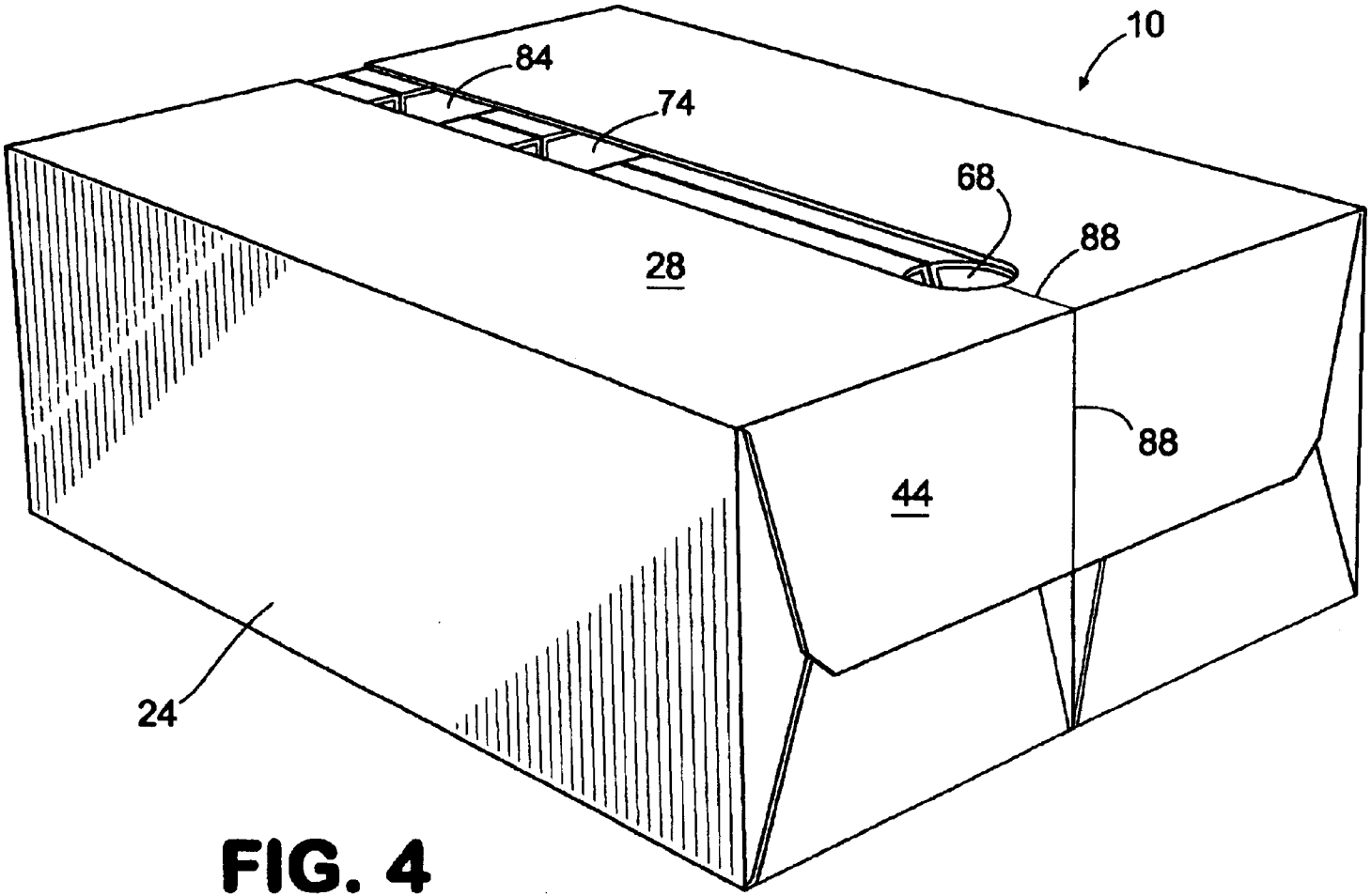
FIG. 4 is a perspective view of the dual carton illustrating a pair of starter orifices after removal of the tear strip.

The blank 12 includes apertures 62, 64, and 66 that are positioned and sized to cooperate with one another when the dual carton 10 is erected. The apertures 62, 64 and 66 cooperate with one another, when erecting the dual carton 10, in order to form a starter orifice 68 in the erected dual carton 10, as shown in FIGS. 2–4. The starter orifice allows the tear strip 60 to be more easily removed from the dual carton 10. Preferably, the apertures 62 and 66 are intersected by fold lines 52 and 54, respectively. Therefore, the apertures 62 and 66 extend from the intermediate panels 16 and 18 onto flap panels 46 and 48, respectively.

The blank 12 also includes apertures 70 and 72 which are positioned and sized to partially register with each other to form the starter orifice 74 (FIG. 4) when the dual carton 10 is erected as described below. Apertures 80 and 82 are also positioned and sized to partially register with each other to form the starter orifice 84 (FIG. 4) when the dual carton is erected. Preferably, the apertures 70 and 80 are intersected by fold line 52 and the apertures 72 and 82 are intersected by fold line 54. Therefore, apertures 70 and 80 extend from flap panel 46 onto the first intermediate panel 16 and apertures 72 and 82 extend from flap panel 48 onto the second intermediate panel 18. In one embodiment, the apertures 70, 72, 80 and 82 may be positioned entirely within flap panels 46 and 48 rather than extending onto the respective intermediate panels 16 and 18.

Figure 5:
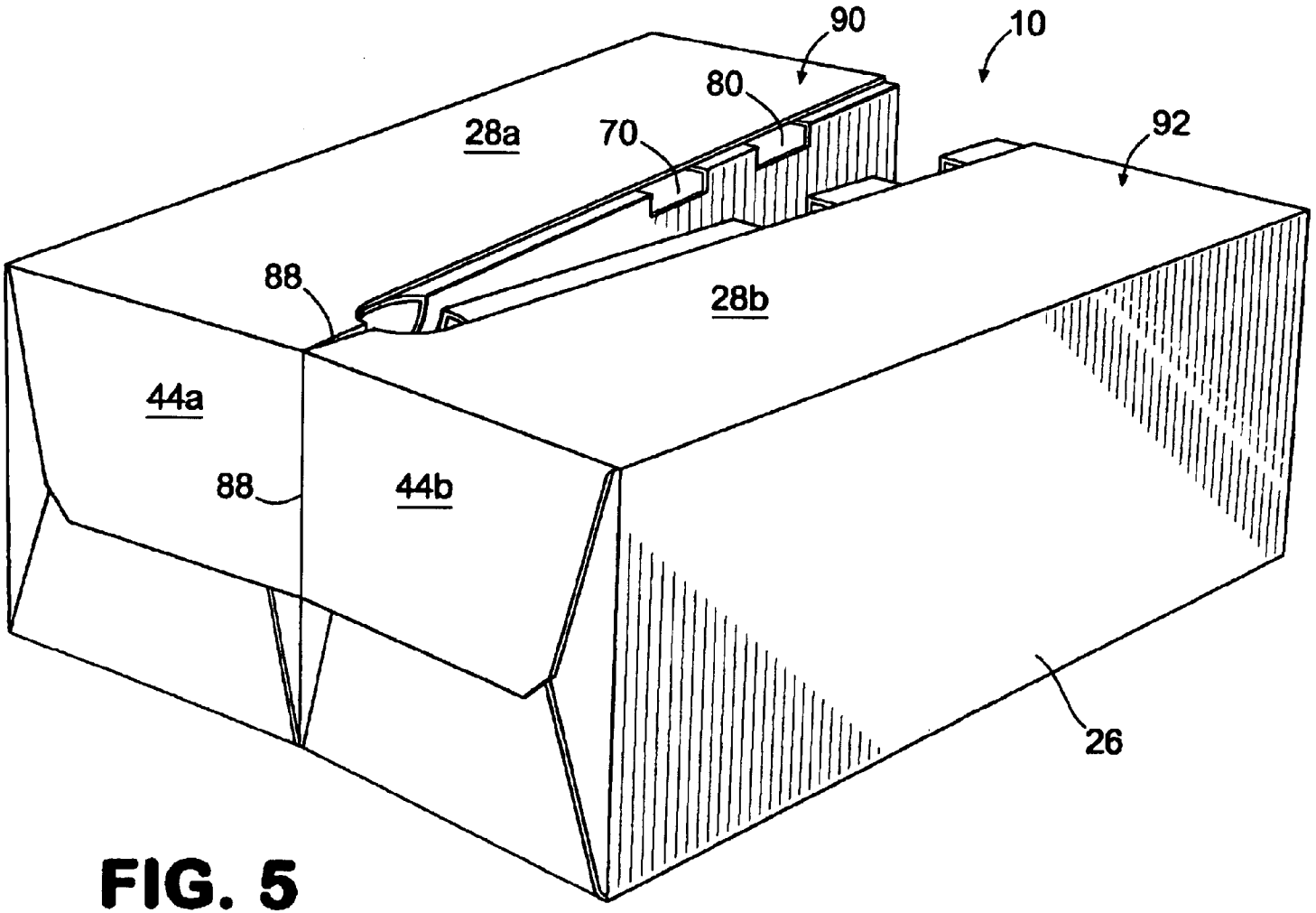
FIG. 5 is a perspective view of the dual carton having been partially separated into individual cartons while utilizing the starter orifices.
Figure 6:
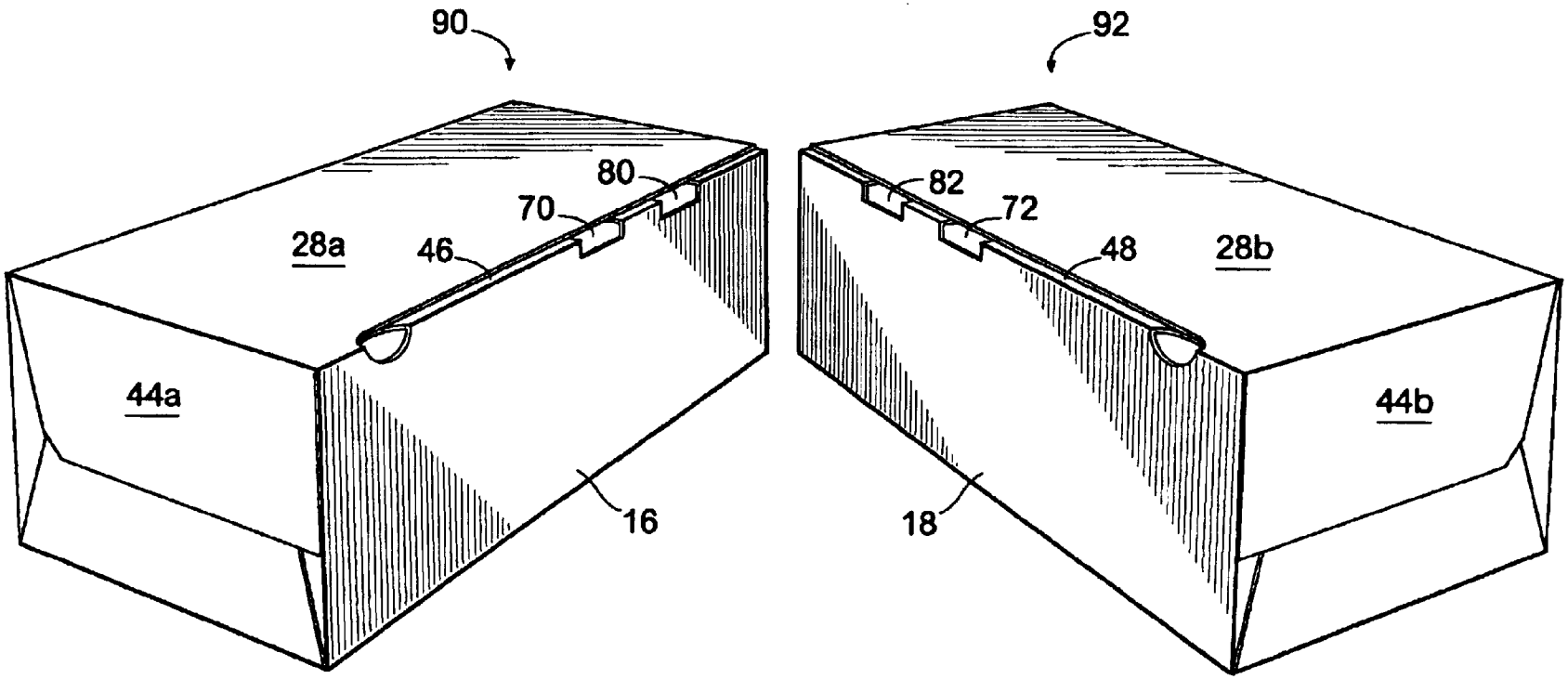
FIG. 6 is a perspective view illustrating the separated individual cartons.

Because the tear strip 60 may not extend the full length of the center top panel 28, the blank 12 of the present invention may also include a weakened line of severance or tear line 88 which extends from the starter orifice 68 on center top panel 28. The weakened line 88 extends from the center top panel 28 into the end flap 44 which defines a portion of an end of the dual carton 10. While the dual carton 10 is being separated into the individual cartons 90 and 92 as shown in FIG. 5, the center top panel 28 is divided into center top panel portions 28*a* and 28*b*. Also, as a result of weakened line 88 extending onto the end flap 44, the end flap 44 is divided into end flaps 44*a* and 44*b* when the dual carton 10 is separated into individual cartons 90 and 92. FIG. 6 illustrates the individual cartons 90 and 92 after having been separated from one another.

The tear strip 60 may be removed from the dual carton 10 when separation of the dual carton 10 into individual cartons is desired. Once at least a portion of the tear strip 60 is removed, the pair of starter orifices 74 and 84 underlying the tear strip are exposed to view and thus become accessible, as shown in FIG. 4, for facilitating the dividing of the dual carton 10 into separate individual cartons 90 and 92. Because the tear strip 60 overlies the starter orifices 74 and 84, the tear strip 60 obscures the starter orifices 74 and 84 from the view of the consumer until the consumer desires to separate the dual carton 10. In one embodiment, the tear strip 60 is defined in the center top panel 28 by a pair of parallel severance lines. Preferably, the width of the starter orifices 74 and 84 substantially corresponds with the width of the tear strip 60.

Preferably, the dual carton 10 provides access to at least two starter orifices 74 and 84, which are displaced from one another so that the consumer can separate the dual carton 10 while his fingers are inserted into the starter orifices 74 and 84 at multiple locations between the individual cartons 90 and 92. However, the present invention contemplates any number of starter orifices for facilitating the separation of the dual carton into individual cartons.

To form the erected dual carton 10, flap panel 46 is folded along fold line 52 onto first intermediate panel 16. Glue is applied to flap panel 46 along the longitudinal edge of flap panel 46. Flap panel 46, first intermediate panel 16 and first bottom panel 20 are folded along fold line 32 onto first side panel 24 and center top panel 28 to secure flap panel 46 to center top panel 28. Then, flap panel 48 and second intermediate panel 18 are folded along fold line 34. Glue is applied to flap panel 48 and either intermediate panel 16 or 18 at locations identified as glue areas by the reference number 98. The glue areas 98 may be defined by frangible lines which permit the glue areas 98 to be displaced from either intermediate panel 16 or 18 when the intermediate panels 16 and 18 are pulled from one another to facilitate separation of the dual carton 10. Flap panel 48, second intermediate panel 18, second bottom panel 22, and second side panel 26 are folded along fold line 40 onto center top panel 28 and first intermediate panel 16 to secure flap panel 48 to center top panel 28 and second intermediate panel 18 to first intermediate panel 16, which results in a flat tubular carton.

Because intermediate panels 16 and 18 are glued face-to-face, aperture 64 in the center top panel 28 registers with at least a portion of each aperture 62 and 66 to form starter orifice 68. The remaining portions of apertures 62 and 66 will be in the vertical plane of the intermediate side panels 16 and 18 when the flat carton is erected into the dual carton 10. Also, because the apertures 70 and 80 are intersected by fold line 52, a portion of each aperture 70 and 80 will remain in the vertical plane of the intermediate panels 16 and 18 and, because the apertures 72 and 82 are intersected by fold line 54, a portion of each aperture 72 and 82 will remain in the vertical plane of intermediate panels 16 and 18. The remaining portions of apertures 70 and 72, the portions within the flap panel 46 and 48, respectively, form the starter orifice 74 as shown in FIG. 4. Also, the remaining portions of apertures 80 and 82, the portions within the flap panel 46 and 48, respectively, form the starter orifice 84 as shown in FIG. 4. Because portions of the apertures 62, 66, 70, 72, 80 and 82 lie within the vertical plane of the intermediate side panels 16 and 18, the consumer is permitted to place fingers further through the starter orifices 68, 74 and 84 without being obstructed by the uppermost edges of the intermediate panels 16 and 18.

The present invention has been illustrated in relation to particular embodiments which are intended in all respects to be illustrative rather than restrictive. Those skilled in the art will recognize that the present invention is capable of many modifications and variations without departing from the scope of the invention. Accordingly, the scope of the present invention is described by the claims appended hereto and supported by the foregoing.

What is claimed is:

1. A separable dual carton for accommodating separate quantities of articles, comprising a tear strip and a plurality of panels connected together, at least one of said panels defining a first starter orifice for facilitating the separation of said dual carton, said tear strip overlying said starter orifice and providing access to said starter orifice when said tear strip is at least partially removed from said dual carton.

2. The dual carton of claim 1 wherein said starter orifice is defined by a flap panel of said plurality of panels, said flap panel being secured to an inside surface of a top panel of said plurality of panels.

3. The dual carton of claim 1 wherein said starter orifice is defined by a flap panel and an intermediate panel of said plurality of panels, said flap panel being secured to an inside surface of a top panel of said plurality of panels, said intermediate panel being hingedly connected to said flap panel and extending downwardly from said flap panel.

4. The dual carton of claim 1 wherein said tear strip obscures said starter orifice from view until said tear strip is at least partially removed from said dual carton.

5. The dual carton of claim 1 further comprising a second starter orifice underlying said tear strip and located at a position displaced from said first starter orifice.

6. The dual carton of claim 1 wherein a width of said tear strip corresponds with a width of said starter orifice.

7. The dual carton of claim 1 wherein said plurality of panels comprises a center top panel, a pair of first and second opposed side panels hingedly connected to opposing side edges of said center top panel respectively, a pair of first and second bottom panels hingedly connected to lower edges of said side panels respectively, a pair of first and second intermediate panel hingedly connected to said bottom panels respectively and extending upwardly to said center top panel, and a pair of first and second flap panels hingedly connected to said intermediate panels respectively and secured to said center top panel.

8. The dual carton of claim 7 further comprising a first aperture defined in one of said flap panels and a second aperture defined in the other flap panel, said first and second intermediate panels are disposed in a face-to-face relationship, and said first and second apertures at least partially register with one another to define said starter orifice.

9. The dual carton of claim 7 wherein said tear strip is defined in said center top panel by a pair of parallel frangible lines.

10. The dual carton of claim 7 wherein said tear strip extends at least partially across said center top panel and at least partially along a first end of said dual carton, and wherein a second end of said dual carton opposite said first end is free of said tear strip.

11. The dual carton of claim 1 further comprising a weakened line extending from said tear strip onto an end of said dual carton.

12. The dual carton of claim 1 wherein said dual carton is made from a single blank.

13. The dual carton of claim 12 wherein outermost fold lines of said blank intersect said first and second apertures respectively.

14. A separable dual carton for accommodating separate quantities of articles formed from a single blank; said blank comprising:

a center top panel;

first and second side panels hingedly connected to opposing side edges of said center top panel;

first and second bottom panels hingedly connected respectively to said first and second side panels at edges of said side panels opposite said center top panel;

first and second intermediate panels hingedly connected respectively to said first and second bottom panels at edges of said bottom panels opposite said side panels;

first and second flap panels hingedly connected respectively to said first and second intermediate panels at edges of said intermediate panels opposite said bottom panels;

a first aperture at least partially defined in said first flap panel and a second aperture at least partially defined in said second flap panel, said intermediate panels assuming a face-to-face relationship when said blank is formed into said dual carton, and said first and second apertures sized and positioned to at least partially register with one another to form a starter orifice for facilitating the separation of said dual carton; and a tear strip defined in said center top panel to overlie said starter orifice when said blank is formed into said dual carton, said tear strip providing access to said starter orifice when said tear strip is at least partially removed from said dual carton.

15. The dual carton of claim 14 wherein said first aperture is defined between said first flap panel and said first intermediate panel, and said second aperture is defined between said second flap panel and said second intermediate panel.

16. The dual carton of claim 14 wherein said tear strip obscures said starter orifice from view until said tear strip is at least partially removed from said dual carton.

17. The dual carton of claim 14 wherein said tear strip extends at least partially across said center top panel and at least partially along a first end of said dual carton, and wherein a second end of said dual carton opposite said first end is free of said tear strip.

18. The dual carton of claim 14 further comprising a second starter orifice for underlying said tear strip displaced from said first starter orifice.

19. The dual carton of claim 14 wherein a width of said tear strip corresponds with a width of said starter orifice.

20. The dual carton of claim 14 further comprising a weakened line extending from said tear strip.

21. The dual carton of claim 14 wherein said tear strip is defined in said center top panel by a pair of parallel tear lines.

22. The dual carton of claim 14 wherein outermost fold lines relative said center top panel of said blank intersect said first and second apertures respectively.

* * * * *